United States Patent [19]

Arnold

[11] 4,016,930

[45] Apr. 12, 1977

[54] OIL WELL PRODUCING METHOD AND SYSTEM

[76] Inventor: James F. Arnold, 241 Kilts Drive, Houston, Tex. 77024

[22] Filed: Oct. 23, 1975

[21] Appl. No.: 624,759

[52] U.S. Cl. ..... 166/266; 166/52; 166/314

[51] Int. Cl.[2] ..... E21B 43/25

[58] Field of Search ..... 166/265, 266, 268, 305 D, 166/313, 314, 52

[56] References Cited

UNITED STATES PATENTS

| | | | |
|---|---|---|---|
| 1,499,589 | 7/1924 | Navin | 166/265 |
| 2,293,196 | 8/1942 | Crump | 166/266 |
| 2,821,255 | 1/1958 | Spearow | 166/313 |
| 3,066,732 | 12/1962 | McEver | 166/265 |
| 3,842,908 | 10/1974 | Thomas et al. | 166/265 |

*Primary Examiner*—Ernest R. Purser

*Attorney, Agent, or Firm*—Marvin B. Eickenroht; W. F. Hyer

[57] ABSTRACT

A method and system is provided wherein water is injected into a producing formation, particularly one which is partially depleted, for flow laterally into an offset well and thence downwardly into a separation zone or cavity which is located at a depth greater than the producing formation. The oil and water separates in the separation zone or cavity and each is separately flowed to the earth's surface. The arrangement is such that substantially no back pressure is exerted from the well into the formation. Preferably, the water is recirculated back for reinjection into the formation. Also, a treating chemical, such as an emulsion breaker can be injected into the separation zone or cavity for phase separation of the oil and water.

13 Claims, 2 Drawing Figures

OIL WELL PRODUCING METHOD AND SYSTEM

This invention relates to a method and system for recovering oil from an oil producing formation, particularly from which oil cannot be economically produced by primary recovery techniques.

It is well known that only a fraction of the oil in place in a formation can be recovered using primary production techniques. These techniques involve the natural flow of oil from the formation into the well from which the oil is pumped or otherwise produced. Secondary recovery techniques have been suggested for recovery of additional oil not producible by primary production techniques. These secondary techniques include such concepts as the injection of a medium such as water to drive the oil toward the producing well. However, this technique in practice has several disadvantages. Also, the producing well is operated so that it inherently causes a back pressure to be applied to the formation. This means that the water injection pressure must be raised accordingly which adds to the production costs. Thus, for example, the oil and water produced into the producing well are pumped or otherwise flowed together to the surface where they are treated as in a separator so as to separate the oil from the water. Since the volume of water is usually much greater than that of the oil, the separator must handle large volumes of liquid and therefore must be large and accordingly relatively expensive. Moreover, the water produced is salt water and is extremely corrosive, particularly in the presence of air. Also, flowing of the oil and water together upwardly through the well sometimes results in emulsions forming which are difficult to break. Such emulsions frequently must be heated in order to break them even in the presence of emulsion treating chemicals. The heating of the large amount of water, as well as the small amount of oil, requires expenditure of large amounts of energy so as to reduce the net equivalent BTU production from the well.

It is an object of this invention to provide a method and system for more efficiently producing an oil well from a formation into which water is injected as a part of the secondary recovery technique.

Another object is to provide such a method and system wherein substantially no back pressure is maintained on the producing formation by the producing well.

Another object is to provide such a method and system wherein the oil and water from the formation are separated downhole and flowed separately to the earth's surface.

Another object is to provide such a method and system wherein the natural heat of earthen formations is employed to aid in effecting a phase separation of water and oil.

Another object is to provide such a method and system arranged to permit oil to flow from a formation solely under the influence of gravity.

Figure 2:
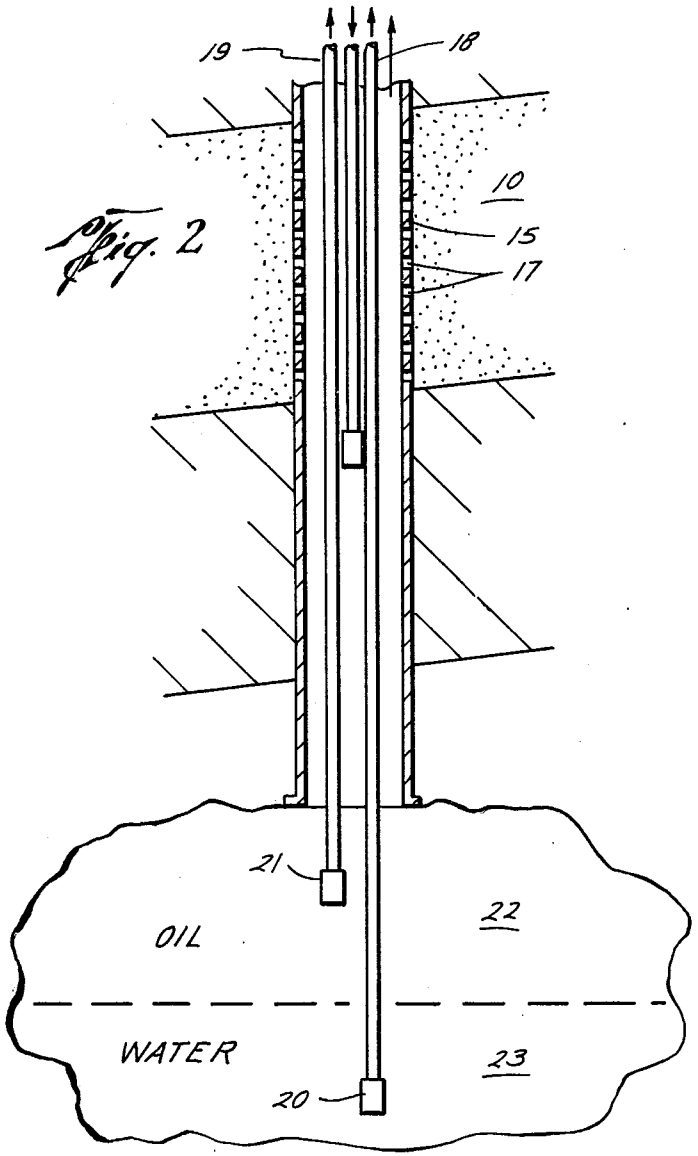
Figure 1:
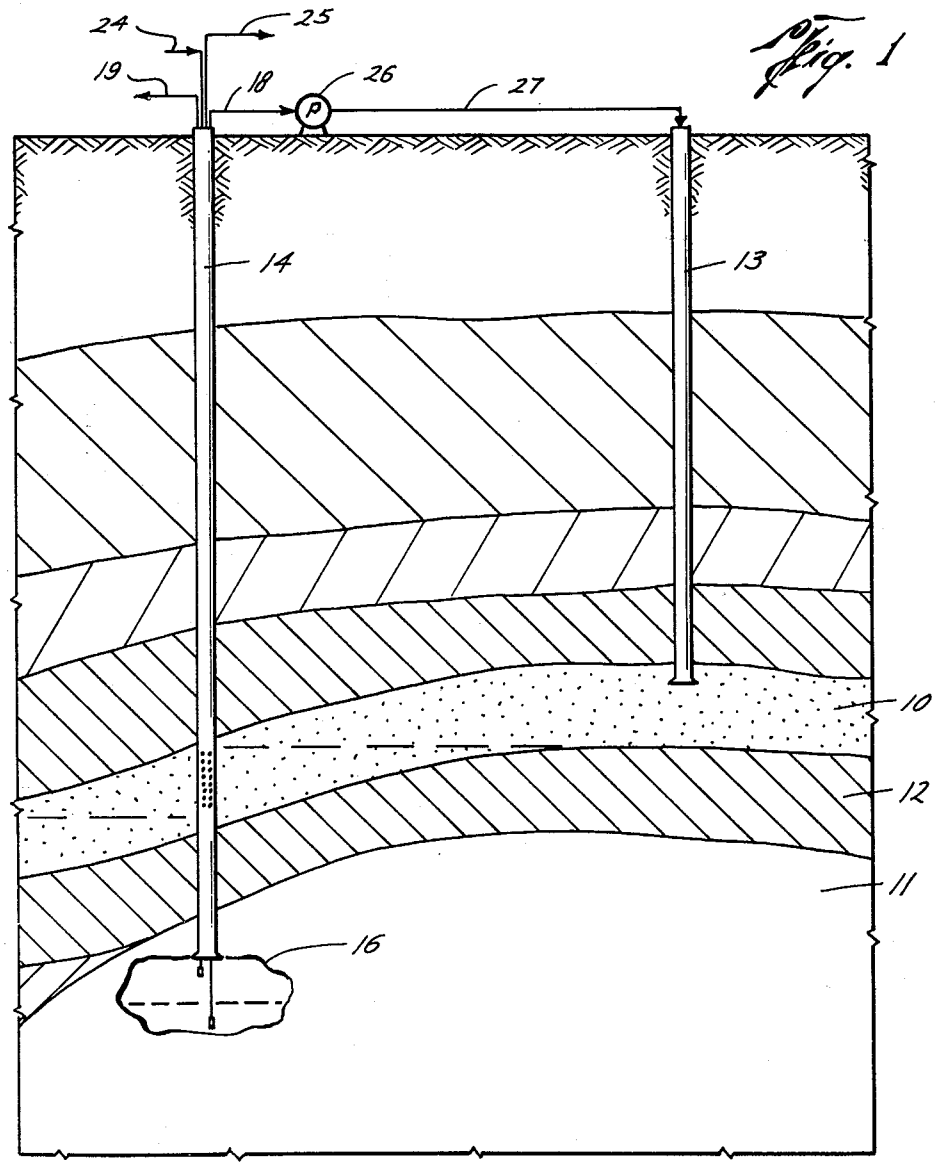

Other objects, advantages and features of the invention will be apparent to one skilled in the art upon consideration of the written specification including the claims and the drawings wherein:

FIG. 1 is a schematic illustration of a preferred embodiment of the invention; and FIG. 2 is an enlarged view of a portion of FIG. 1.

Referring to the drawings, there is illustrated a preferred embodiment of the invention, involving a producing formation overlying a salt dome. Thus, producing formation 10 overlies salt dome 11 and is frequently separated therefrom by a cap rock 12. A conventional well 13 has been previously drilled into the producing formation and a certain amount of oil produced therefrom by primary production techniques. At some point in time, the production from well 13 has become economically marginal albeit the producing formation still contains substantial quantities of oil.

In accordance with this invention, a second well 14 is drilled and completed through the formation 10 and a separation zone is established at a depth deeper than and in fluid communication with the formation. Thus, the well 14 is drilled through formation 10 into salt dome 11. The preferred separation zone is established by washing salt out of the salt dome at the lower end of well 14 using known techniques. For example, after casing 15 has been set but before it is perforated, a tubing string (not shown) can be run through the casing to discharge fresh water from the lower end of the casing. This fresh water dissolves the salt and the resultant brine is recirculated to the surface through the tubing-casing annulus. The circulation of fresh water into the salt dome can be continued until a cavity 16 of desired size has been formed. Thereafter the tubing is withdrawn and the casing is perforated as at 17 using conventional techniques. This establishes fluid communication between the producing zone 10 and the well 14. Thereafter, tubing or macaroni strings 18 and 19 are run into the well, with pumps 20 and 21 attached to the lower ends thereof, respectively. Pumps 20 and 21 can be of any desired type but preferably are fluid actuated as, for example, Reda pumps. As will be pointed out in more detail hereafter, cavity 16 receives oil and water from the producing zone and this oil and water separates into two phases, namely an oil phase 22 and a water phase 23. Tubing string 18 extends so that its pump 20 lies within the water phase whereas tubing string 19 extends so that its pump 21 lies in the oil phase. Hence upon operation of these respective pumps, oil and water are pumped to the earth's surface independently of each other. This minimizes emulsion formation during the pumping operation as is common when both oil and water are pumped to the earth's surface through a common tubing string.

If desired, a third tubing string 24 can be run into the well to inject treating chemicals or agents capable of facilitating the separation of oil and water into separate phases. This tubing string preferably terminates above cavity 16 but, if desired, it can be extended into the cavity.

In accordance with this invention, salt water is flowed through well 13 and into producing formation 10 at a point which is laterally offset from well 14. The injected water flows toward well 14 washing and otherwise displacing hydrocarbons from the formation for flow into the well 14 via perforations 17. Pumps 20 and 21 are operated in such a manner that the liquid level in well 14 is below producing formation 10 and preferably is within cavity 16. Accordingly, any liquid flowing from formation 10 into the well fall by gravity down into the cavity 16. In this connection, any gas which may be present is flowed through the casing to be discharged at 25. Overall, the aim is to maintain zero or atmospheric back pressure on formation 10 at the point of perforations 17.

As the oil and water accumulate in cavity 16, they can be respectively pumped therefrom to the earth's surface either continuously or periodically. In this connection, the pumps 20 and 21 can be operated responsive to suitable liquid level devices (not shown) to maintain the accumulated volume of oil and water more or less constant and to avoid pumping oil out through the water string and vice versa.

The separation of the produced oil and water into separate phases in cavity 16 is facilitated by the heating effect thereon by virtue of the elevated temperature of the salt dome. Additionally, the injection of treating agents or chemicals into the fluid falling into the cavity also facilitates this separation. The heating effect of the subterranean salt dome avoids the burning of fuels in conventional surface separators thereby conserving energy.

In a preferred embodiment, the salt water produced from well 14 is recirculated via pump 26 and line 27 to well 13. This recirculated brine eventually becomes saturated with salt so that thereafter, additional salt is not dissolved from the salt dome and the size of cavity 16 becomes stable.

After a period of production as above described, the quantity of oil produced may not justify the cost of pumping and handling of the recirculating water. At such time, the recirculation can be terminated and production of oil continued by allowing the oil to flow from the formation into cavity 16 under the influence solely of gravity. Since the back pressure on the formation will be atmospheric, there will exist optimum conditions for the gravity flow of oil into the cavity. The oil can be pumped to the surface from time to time as it accumulates in the cavity. Similarly, any produced water can be pumped out and disposed of as by pumping it into a separate salt water disposal well.

From the foregoing it will be seen that this invention is one well adapted to attain all of the ends and objects hereinabove set forth, together with other advantages which are obvious and which are inherent to the method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A method for producing oil from an oil producing formation comprising the steps of drilling and completing a well through such formation and establishing a separation zone at a depth deeper than, and in fluid communication with said formation; flowing water into said formation at an injection point offset from said well and causing such water to flow laterally through said formation into said well; flowing water from a lower portion of said separation zone upwardly through said well to the earth's surface; flowing oil from an upper portion of said separation zone to the earth's surface, and adjusting the rate of flow of water and oil from the separation zone to be such that the level of oil is maintained below said formation.

2. The method of claim 1 including the step of maintaining essentially atmospheric pressure in said well adjacent said formation.

3. The method of claim 1 wherein at least a portion of the water flowing from said well is recirculated back into said formation at said injection point.

4. The method of claim 1 wherein said separation zone is established in a salt dome by washing salt therefrom.

5. The method of claim 1 wherein the step of flowing water into said formation is terminated and thereafter oil is permitted to flow by gravity from said formation into said well.

6. The method of claim 1 wherein a chemical treating agent is injected into said well to flow with the oil and water from said formation into said separation zone, said agent being capable of facilitating the separation of said oil and water into separate phases.

7. A method for producing oil from an oil producing formation overlying a salt dome which formation has been previously produced through a first well comprising the steps of drilling and completing a second well through said formation into said salt dome and offset from the first well; establishing a cavity in said salt dome at a lower portion of said second well below said formation and in communication with said formation via said second well; flowing salt water into said formation via said first well and causing such water to flow laterally through said formation and downwardly into said cavity via the second well; separately flowing water from a lower portion of said cavity to the earth's surface via said second well and (ii) flowing oil from an upper portion of said cavity to the earth's surface via said second well; and adjusting the rate of flow of water and oil from the cavity to be such that the level of oil is maintained below said formation.

8. The method of claim 7 wherein said cavity is established by circulating fresh water into the salt dome via the second well.

9. The method of claim 7 wherein communication of said formation with said second well is at an elevation which is less than that at which said salt water is injected.

10. A system for producing oil from a formation overlying a salt dome comprising a first well extending into said formation, a second well laterally offset from the first well and passing through said formation into said salt dome, means providing fluid communication between said formation and said second well, a cavity in said salt dome at a lower portion of said second well below said formation and in communication with said second well; means for flowing water into said first well and thence into said formation for lateral flow to said second well. and means for separately flowing oil and water from the upper and lower portions of said cavity, respectively, to the earth's surface via the second well.

11. The system of claim 10 including means for recirculating at least a portion of the water flowing from said second well into said first well.

12. The system of claim 11 including means for injecting a treating chemical into said second well at a point below said fluid communication means for mixing with the oil and water flowing into said cavity.

13. The system of claim 10 wherein said fluid communication means are located at an elevation which is less than that at which water is injected into the formation from the first well.

* * * * *